US005725421A

United States Patent [19]

Goers et al.

[11] Patent Number: 5,725,421

[45] Date of Patent: Mar. 10, 1998

[54] APPARATUS FOR ROTATIVE ABRADING APPLICATIONS

[75] Inventors: Brian D. Goers, Minneapolis; Troy W. Heuermann, Maplewood; Gary M. Palmgren, Lake Elmo, all of Minn.

[73] Assignee: Minnesota Mining and Manufacturing Company, St. Paul, Minn.

[21] Appl. No.: 607,757

[22] Filed: Feb. 27, 1996

[51] Int. Cl.[6] ..... B24B 21/00

[52] U.S. Cl. ..... 451/303; 451/49

[58] Field of Search ..... 451/303, 59, 168, 451/173, 538, 539, 526, 317, 49; 51/295, 296

[56] References Cited

U.S. PATENT DOCUMENTS

| | | | |
|---|---|---|---|
| 1,908,048 | 5/1933 | Player et al. . | |
| 3,860,400 | 1/1975 | Prowse et al. | 51/295 |
| 4,541,842 | 9/1985 | Rostoker | 51/296 |
| 4,652,275 | 3/1987 | Bloecher et al. | 51/298 |
| 4,682,444 | 7/1987 | Judge et al. | 51/154 |
| 4,773,920 | 9/1988 | Chasman et al. | 51/295 |
| 4,799,939 | 1/1989 | Bloecher et al. | 51/293 |
| 4,993,191 | 2/1991 | Judge et al. | 51/154 |
| 5,049,165 | 9/1991 | Tselesin | 51/295 |
| 5,092,910 | 3/1992 | deKok et al. | 51/295 |
| 5,095,663 | 3/1992 | Judge et al. | 451/49 |
| 5,109,638 | 5/1992 | Kime, Jr. | 51/401 |
| 5,152,917 | 10/1992 | Pieper et al. | 51/295 |
| 5,190,568 | 3/1993 | Tselesin | 51/293 |
| 5,203,880 | 4/1993 | Tselesin | 51/293 |
| 5,435,816 | 7/1995 | Spurgeon et al. | 51/295 |
| 5,437,125 | 8/1995 | Barton, II | 451/49 |
| 5,490,808 | 2/1996 | Jantschek et al. | 451/59 |
| 5,531,631 | 7/1996 | Judge | 451/49 |
| B1 5,049,165 | 9/1995 | Tselesin | 51/295 |

FOREIGN PATENT DOCUMENTS

| | | | |
|---|---|---|---|
| WO 91/10538 | 7/1991 | WIPO . | |
| WO 92/05827 | 4/1992 | WIPO | A61M 21/00 |
| WO 95/09216 | 4/1995 | WIPO | C09K 11/06 |

OTHER PUBLICATIONS

*Crankshafts finished and sized* by Norman R. Judge, pp. 32–33, 36, 40, Jun. 1995 issue of American Machinist.

3M Superabrasives and Microfinishing Systems Product Guide, ©3M 1994 60–4400–4692–2 (104.3) JR (technical information).

*Primary Examiner*—James G. Smith
*Assistant Examiner*—Derris H. Banks
*Attorney, Agent, or Firm*—Michaele A. Hakamaki

[57] ABSTRACT

A support shoe for supporting an abrasive tape having an abrasive face and an opposed back face, wherein the support shoe comprises a pressure face including a frictional engagement material for frictionally engaging the back face of the abrasive tape. The frictional engagement material comprises a plurality of cells and a first frictional engagement surface comprising a plurality of particles distributed and arranged within the plurality of cells, wherein at least some of the plurality of particles are fixed within and extend from the plurality of cells, so that when the back face of the abrasive tape contacts the first frictional engagement surface, the plurality of particles attenuate relative movement between the abrasive tape and the pressure face in response to shear forces induced during abrading. The pressure face may be curvilinear, arcuate, convex, or concave. The frictional engagement material may be attached to the pressure face by brazing, sintering, adhering, or soldering. The back face of the abrasive tape may include a second frictional engagement surface, so that when the second frictional engagement surface contacts the first frictional engagement surface, the plurality of particles attenuate relative movement between the abrasive tape and the pressure face in response to shear forces induced during abrading. The frictional engagement material may further comprise a matrix material in the cells for holding the plurality of particles within the cells, wherein this matrix material may comprise a sintered matrix material.

19 Claims, 5 Drawing Sheets

APPARATUS FOR ROTATIVE ABRADING APPLICATIONS

TECHNICAL FIELD

The present invention relates to an apparatus for abrading a workpiece, such as a journal. More particularly, the present invention provides an apparatus for attenuating relative displacement between an abrasive tape and a support shoe during rotational abrasive contact between the abrasive tape and an outer peripheral surface of a workpiece.

BACKGROUND OF THE INVENTION

It is common to use abrasives to abrade specified amounts of material from the outer surface of a workpiece to provide a desired workpiece shape and surface finish. In the automotive field, for example, journals such as camshafts and crankshafts for internal combustion engines must meet exacting standards for geometry and surface finish. If a camshaft or a crankshaft is improperly sized or finished, undesired uneven wear patterns may result.

One manner of finishing the outer peripheral surface of a workpiece, such as a journal, is to provide a support shoe having a smooth pressure face against which an abrasive sheet or tape is placed. In some cases, the support shoe is provided with conventional honing shoe inserts, where the pressure face of the support shoe includes the smooth surface of the honing shoe inserts. The workpiece, the support shoe, or both the workpiece and the support shoe are moved so that the abrasive face of the tape is brought in contact with the surface of the workpiece. The workpiece is then rotated with respect to the support shoe to abrade the workpiece surface. The abrasive tape may be, for example, a coated abrasive, a lapping abrasive, or a nonwoven abrasive. Examples of camshaft and crankshaft microfinishing are described in U.S. Pat. No. 4,682,444 (Judge et al.) and U.S. Pat. No. 4,993,191 (Judge et al.).

After a certain amount of use, the portion of the abrasive sheet or tape contacting the workpiece will begin to degrade or wear out, which can cause irregular finishing of the workpiece. To continue abrading workpieces, it is therefore common to advance the abrasive tape periodically to provide a new abrasive surface to the workpiece. Advancing the abrasive tape in this manner is referred to as "indexing" the abrasive tape, where the tape is typically indexed a specific amount after each workpiece or a series of workpieces is abraded. To allow for ease in indexing the abrasive, the abrasive tape or sheet typically is not permanently fixed or adhered to the pressure face.

Although the abrasive tape is typically releasable from the pressure face to allow indexing, for proper finishing of workpieces, it is also important to maintain the abrasive tape in position with respect to the pressure face during the abrading process. If the abrasive tape slips, it may not be properly positioned over the pressure face, which may cause the abrasive tape to tear or break. In automated abrading processes, a dislocation of or break in the tape may damage multiple workpieces before the dislocation or break is detected. In addition, if a broken abrasive tape wraps around the workpiece, the manufacturing equipment may be damaged, which can cause the manufacturing operation to shut down. Moreover, if the abrasive tape slips such that it becomes significantly displaced with respect to the pressure face, portions of the pressure face may be exposed to the workpiece during abrasion. In this situation, the workpiece may contact the pressure face rather than the abrasive tape during the abrading process, which may cause improper finishing of the workpiece, and may damage both the workpiece and the pressure face.

Unfortunately, some manufacturing processes actually promote slippage between the abrasive tape and the pressure face. For example, in some applications, lubricants such as mineral seal oil are provided at the abrasive interface between the surface of the workpiece and the abrasive tape to carry abraded particles away from the abrasive interface, and to promote heat transfer from the workpiece. Unfortunately, it is often difficult to confine the lubricants to only the abrasive interface, and the lubricants can seep between the abrasive tape and the pressure face. Because the abrasive tape is subjected to a rotary shear force during abrading, and to a shear force if the workpiece is moved transversely, these lubricants tend to facilitate slippage between the abrasive tape and the pressure face.

One manner of reducing slippage of the abrasive tape with respect to the pressure face is to apply a slip resistant coating to the back face of the abrasive tape. For example, Minnesota Mining and Manufacturing Company of St. Paul, Minn. sells abrasive tapes under the trade designations 262L and 272L IMPERIAL Microfinishing film product Type S, and 263L and 273L IMPERIAL Microfinishing film product Type Q. Abrasive tapes of this type include a slip resistant coating disposed on the back face of a film, comprising an inorganic particulate dispersed in a polymeric binder. Another example of a method for reducing slippage is described in U.S. Pat. No. 5,109,638 (Kime, Jr.), which discloses a coated abrasive material provided with a thin layer of a gripper coating, which is preferably a non-tacky material having a textured outer surface such as a veined stippling pattern. These slip resistant coatings tend to reduce slippage between the abrasive tape and the pressure face, which is generally smooth and free of irregularities such as bumps, grooves, ridges, and the like. However, the ability of the slip resistant coatings to reduce slippage may be limited by the smoothness of the pressure face.

Another manner of reducing slippage of the abrasive tape with respect to the pressure face is to provide a microstructured surface comprising a plurality of tapered elements on the back face of the abrasive tape that are specifically designed to intermesh and mechanically engage with tapered elements that are provided on the pressure face of the support shoe. These microstructured surfaces hold the abrasive tape to the pressure face when the surfaces contact each other, as described in U.S. Pat. No. 5,490,808, entitled "Abrasive Attachment System for Rotative Abrading Applications" (Jantschek, et al.), which is commonly owned by the assignee of the present invention. Although these specifically designed intermeshing surfaces satisfactorily secure the abrasive tape to the pressure face, this method requires that both the abrasive tape surface and the pressure face surface have very specific microstructured surfaces to allow for proper mechanical engagement between the surfaces.

SUMMARY OF THE INVENTION

In one aspect of this invention a support shoe is provided for supporting an abrasive tape having an abrasive face and an opposed back face, wherein the support shoe comprises a pressure face including a frictional engagement material for frictionally engaging the back face of the abrasive tape. The frictional engagement material comprises a plurality of cells and a first frictional engagement surface comprising a plurality of particles distributed and arranged within the plurality of cells, wherein at least some of the plurality of particles are fixed within and extend from the plurality of cells, so that when the back face of the abrasive tape contacts the first frictional engagement surface, the plurality of extending particles attenuate relative movement between the abrasive tape and the pressure face in response to shear forces induced during abrading.

The present invention includes within its scope a pressure face that is curvilinear, arcuate, convex, or concave. Also included within the scope is that the frictional engagement material may be attached to the pressure face by brazing, sintering, adhering, or soldering.

The back face of the abrasive tape may include a second frictional engagement surface, so that when the second frictional engagement surface contacts the first frictional engagement surface, the plurality of particles attenuate relative movement between the abrasive tape and the pressure face in response to shear forces induced during abrading.

The frictional engagement material may further comprise a matrix material in the cells for holding the plurality of extending particles within the cells, wherein this matrix material may comprise a sintered matrix material.

In another aspect of the present invention, an apparatus is provided for abrading an outer peripheral surface of a workpiece, wherein the apparatus comprises an abrasive tape having an abrasive face and an opposed back face, and a support means having a pressure face for supporting the abrasive tape thereon and for urging the abrasive tape against the workpiece. The pressure face includes a frictional engagement material for frictionally engaging the back face of abrasive tape, wherein the frictional engagement material comprises a plurality of cells and a first frictional engagement surface comprising a plurality of particles distributed and arranged within the plurality of cells, wherein at least some of the plurality of particles are fixed within and extend from the plurality of cells, so that when the back face of the abrasive tape contacts the first frictional engagement surface, the plurality of particles attenuate relative movement between the abrasive tape and the pressure face in response to shear forces induced during abrading. The apparatus also comprises a means for rotating one of the workpiece and the support means relative to the other of the workpiece and the support means, whereby the abrasive face abrades material from the outer peripheral surface of the workpiece during relative rotation between the workpiece and the support means.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

The present invention generally relates to an apparatus for abrading a workpiece, such as a journal. More specifically, the apparatus includes an abrasive tape and a support shoe having a frictional engagement material on a pressure face for frictionally engaging the abrasive tape. The frictional engagement between the frictional engagement material and the abrasive tape attenuates relative displacement of the abrasive tape as the workpiece is rotatively abraded. Although the workpiece is typically rotated with respect to a stationary support shoe, the workpiece could be held stationary and the support shoe rotated, or the two components could be rotated in opposite directions simultaneously. Thus the present invention should be understood to have utility in rotative abrading generally.

The term "tape," as used throughout this description when referring to the abrasive, is not intended to limit the relative size or construction of the abrasive member used in conjunction with the present invention. Typically, the abrasive tape of the present invention is a narrow strip of abrasive material, where the length of the material is significantly larger than its width. The tape is typically provided by a supply roll of abrasive tape to the abrading apparatus. The present invention is particularly useful for abrading journals such as camshafts and crankshafts, although other uses are contemplated.

Figure 1:
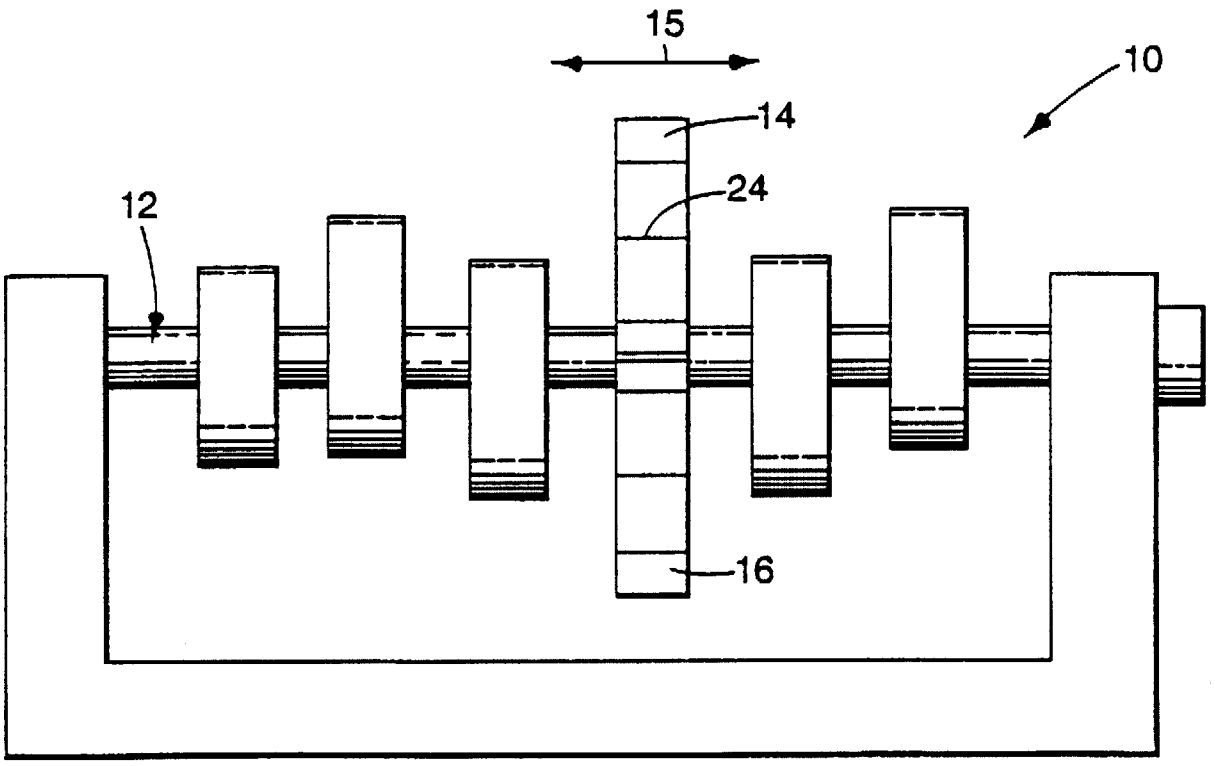
Fig. 1 PRIOR ART
FIG. 1 is a side view of an apparatus for abrading a workpiece.
Figure 2:
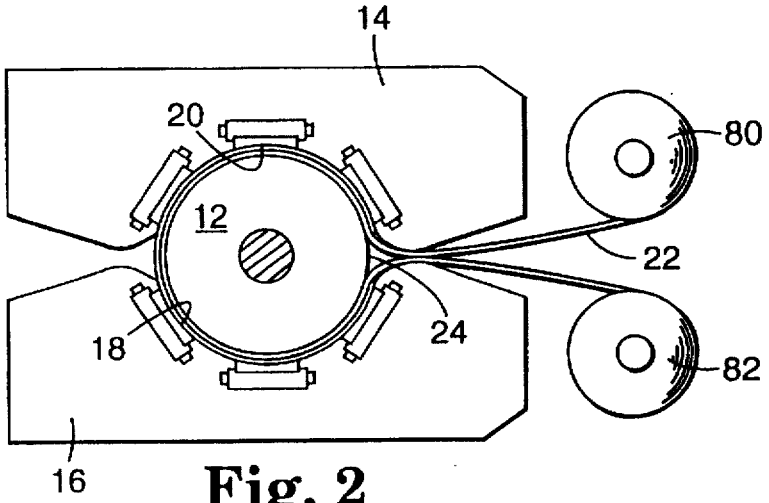
Fig. 2 PRIOR ART
FIG. 2 is a cross-sectional view of a support shoe, abrasive tape, and a workpiece.

FIGS. 1 and 2 illustrate a prior art apparatus 10 for abrading material from the individual peripheral surfaces of a workpiece 12. Support shoes 14 and 16 include pressure faces 18 and 20 that are typically concave, and match the desired profile of the peripheral surface of the workpiece 12 being abraded. In the illustrated embodiment, two semicylindrical pressure faces 18 and 20 urge abrasive tape 22 against surface 24 of workpiece 12. When workpiece 12 is rotated, abrasive tape 22 abrades material from the outer peripheral surface 24, due to pressure from pressure faces 18 and 20 against the surface. Pressure faces 18 and 20 may also be moved transversely (i.e., oscillated) across the peripheral surface 24 as the workpiece is rotated, as shown by directional arrows 15. Transverse motion of the pressure faces produces a multidirectional scratch pattern on the surface of the workpiece, which may be desirable for certain applications. It is also known to abrade or finish more than one peripheral surface simultaneously.

Figure 3:
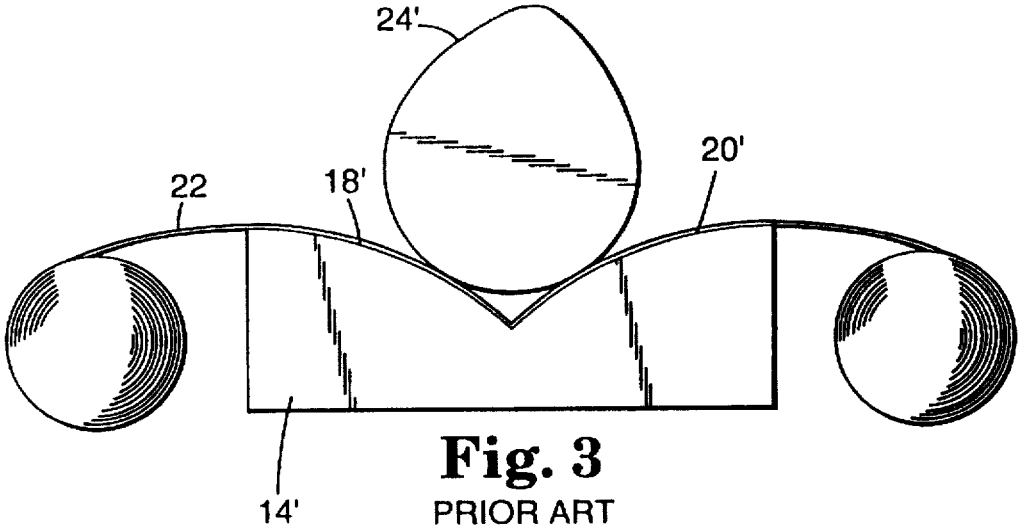
Fig. 3 PRIOR ART
FIG. 3 is an alternate embodiment of a support shoe.

Support shoes 14 and 16 typically include pressure faces 18 and 20, respectively, which conform to the surface of the workpiece to be abraded. For example, in FIG. 2 a cylindrical portion of a workpiece 12 is adapted for rotation with respect to support shoes 14 and 16 that include semicylindrical pressure faces 18 and 20. FIG. 3 illustrates an alternative embodiment, where support shoe 14' includes convex pressure faces 18' and 20' that are adapted to present an abrasive tape 22 for contact with a surface 24'. Other support shoe and pressure face configurations are also within the scope of the invention, and may be selected as known in the art. For example, the support shoe may include a pressure face that is planar, curvilinear, arcuate, convex, concave, or combinations of planar and curvilinear surfaces.

Figure 4:
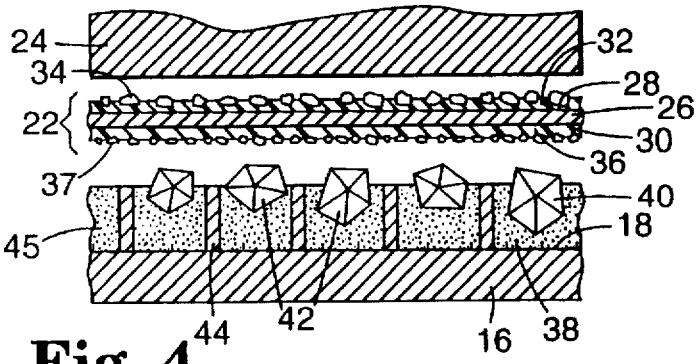
FIG. 4 is an exploded cross-sectional view of the interface between the support shoe, the abrasive tape, and the workpiece in accordance with the present invention.

As shown in FIG. 4, a preferred embodiment of the present invention includes an abrasive tape 22 which comprises a substrate 26 having a front face 28 with an abrasive coating thereon, and a back face 30, onto which a backing layer 36 is provided. In addition, the support shoe 16 has a pressure face 18 to which a frictional engagement material 38 is attached for frictionally engaging the backing layer 36 of the abrasive tape 22.

More specifically, the abrasive tape 22 is of the type that preferably includes a slip resistant coating disposed on the back face of a substrate, the slip resistant coating generally comprising an inorganic particulate dispersed in a polymeric binder. Examples of the abrasive tape 22 include 262L and 272L IMPERIAL Microfinishing film product Type S, and 263L and 273L IMPERIAL Microfinishing film product Type Q, commercially available from the Minnesota Mining and Manufacturing Company of St. Paul, Minn.

In one preferred embodiment, the abrasive tape 22 is a coated abrasive as is known in the art which comprises a plurality of abrasive particles 34 attached to the substrate 26. The substrate 26 may comprise, for example, a polymeric film, (including primed polymeric film), cloth, paper, a nonwoven material, rubber, or combinations thereof.

The abrasive tape 22 preferably further includes a first binder 32 applied over the front face 28 of the substrate 26. The plurality of abrasive particles 34 are typically embedded into the first binder 32. The first binder 32 may be formed from a binder precursor, which is typically a liquid provided in an unpolymerized state. During the manufacture of an abrasive material such as the abrasive tape 22, the binder precursor may be converted to a solidified binder. Examples of typical abrasive article binders include: phenolic resins, aminoplast resins having pendant alpha, beta unsaturated carbonyl groups, urethane resins, hide glue, epoxy resins, acrylate resins, acrylated isocyanurate resins, urea-formaldehyde resins, isocyanurate resins, acrylated urethane resins, acrylated epoxy resins, and mixtures thereof. The binder precursor may further include a catalyst, curing agent or initiator to either initiate and/or accelerate the curing of the binder precursor to the binder. The binder precursor can further comprise additives, such as fillers, fibers, antistatic agents, humectants, lubricants, fire retardants, wetting agents, surfactants, pigments, dyes, coupling agents, plasticizers, suspending agents, and the like.

A second binder (not shown), commonly referred to as a size coat, may be applied over the abrasive particles 34. When using a size coat, the first binder 32 is commonly referred to as a make coat. Typical examples of size coat materials include the same materials described above for the first binder 32. In some embodiments, a third binder (also not shown), commonly referred to as a supersize coating, may be applied over the second binder. A supersize coating is typically used to minimize loading of the abrasive substrate. The term "loading" refers to the situation when the spaces between abrasive particles become filled with the material abraded from a surface such as a cam shaft. Specific supersize coatings that may be used include metal salts of fatty acids, urea-formaldehyde, waxes, mineral oils, crosslinked silanes, crosslinked silicones, fluorochemicals, metal stearate salts such as zinc stearate or calcium stearate, and the like, including combinations of supersize coatings in a single embodiment. Specifically, a supersize coating may be utilized in the present invention to minimize the buildup between the abrasive particles 34 of the material abraded from the cam shaft surface. The specific materials and components forming the abrasive tape 22 may be selected to provide a desired abrading performance.

The abrasive particles 34 are preferably between 0.01 micrometer and 400 micrometers in size, and are more preferably between 1 micrometer and 120 micrometers, although finer or coarser particles may used as desired for the particular application. The abrasive particles 34 may comprise, for example, fused aluminum oxide, ceramic aluminum oxide, heat treated aluminum oxide, silicon carbide, alumina zirconia, diamond, iron oxide, white aluminum oxide, silica, ceria, iron oxide, cubic boron nitride, garnet and combinations thereof.

The abrasive particles 34 may also comprise an abrasive agglomerate formed from single abrasive particles bonded together. Agglomerates typically comprise a plurality of abrasive particles held together by a binder, such as a resinous, glass, ceramic, or metal binder. The agglomerates are preferably between 1 micrometer and 1500 micrometers in size, and more preferably are between 60 micrometers and 500 micrometers in size. The agglomerates may be precisely shaped or irregular. Examples of shaped agglomerates include cubes, four-sided pyramids, and truncated pyramids. Abrasive agglomerates are further described in U.S. Pat. No. 4,652,275, entitled "Erodable Agglomerates and Abrasive Products Containing the Same" (Bloecher et al.); U.S. Pat. No. 4,799,939, entitled "Erodable Agglomerates and Abrasive Products Containing the Same" (Bloecher et al); U.S. Pat. No. 4,541,842, entitled "Glass Bonded Abrasive Agglomerates" (Rostoker); and U.S. patent application Ser. No. 08/085,638, entitled "Precisely Shaped Particles and Method of Making the Same" (Holmes et al.), which is commonly owned by the assignee of the present invention.

In some cases, it is preferable that the abrasive particles 34 are applied in a "closed coat" configuration, where the abrasive particles 34 are embedded into the first binder 32 so that there is minimal space between the abrasive particles 34. In other cases, it is preferable to apply the abrasive particles 34 to the first binder 32 in an "open coat" configuration so that there are larger spaces between the abrasive particles 34 than in a closed coat configuration. Like the supersize coat discussed above, the open spaces between the abrasive particles 34 can effect the mount of loading of the abrasive tape 22.

One alternative construction of the abrasive tape 22 is referred to as a lapping coated abrasive (not shown), in which an abrasive composite is bonded to the front surface of a backing. The lapping coated abrasive comprises a plurality of abrasive particles distributed throughout a binder, where the binder also serves to bond the abrasive composite to the backing. One example of such a lapping film is described in U.S. Pat. No. 4,773,920, entitled "Coated Abrasive Suitable for Use as a Lapping Material" (Chasman et al.), the entire disclosure of which is incorporated herein by reference.

Another alternative construction is a structured abrasive with three dimensional, precisely shaped abrasive composites bonded to a backing, such as that described in U.S. Pat. No. 5,152,917, entitled "Structured Abrasive Article" (Pieper et al.), and in U.S. Pat. No. 5,435,816, entitled "A Method of Making an Abrasive Article" (Spurgeon et al.), the entire contents of both of which are incorporated herein by reference. These precisely shaped abrasive composites may comprise various geometric shapes such as pyramids, truncated pyramids, cones, spheres, rods, tapered rods, and the like.

The abrasive tape 22 also preferably includes a backing layer 36 attached to the back face 30 of the substrate 26. More specifically, one example of a backing layer 36 is a coating comprising particles 37 of calcium carbonate in an adhesive material, as is used on the 262L or 272L IMPERIAL Microfinishing film product Type S. In this example, the adhesive material may be the same or different from the first binder 32. Another example of a backing layer 36 is an abrasive composite comprising particles 37 made of quartz in an adhesive material, as is used on the 263L or 273L IMPERIAL Microfinishing film product Type Q. The adhesive material may be selected from the adhesives appropriate for use in the Type S material.

The particles 37 of the backing layer 36 may comprise particles of various sizes, shapes, and compositions. The particles are typically selected to provide certain properties for the backing layer. For example, when it is desirable for the backing layer 36 to have a relatively rough surface, quartz particles may be preferable to calcium carbonate particles since quartz particles are typically harder than calcium carbonate particles. Other particles may also be used in the abrasive composite of the backing layer 36, such as clay, metal shavings (e.g., bronze), fused aluminum oxide, ceramic aluminum oxide, heat treated aluminum oxide, silicon carbide, alumina zirconia, diamond, iron oxide, mullite, white aluminum oxide, silica, ceria, iron oxide, cubic boron nitride, garnet and combinations thereof.

While an abrasive tape having a backsize coating as the backing layer is preferred, other tape configurations are also within the scope of the present invention. For example, the abrasive tape may have no backsize coating or may include any other type of coating on the back face 30, such as the gripper coating described in U.S. Pat. No. 5,109,638 (Kime, Jr.). For another example, the substrate 26 may be a resilient foam, such as a urethane or acrylate, or may be a polymeric film coextruded with a polyester on one side and a polyolefin on the opposite side.

As described above, the support shoe 16 has a pressure face 18 to which a frictional engagement material 38 is attached for frictionally engaging the backing layer 36 of the abrasive tape 22. The frictional engagement material 38 is preferably attached to the pressure face 18 by known attachment methods, such as brazing, sintering, soldering, adhering such as with an epoxy, and the like. In the preferred embodiment, an epoxy tape, such as AF 126 Scotchweld™ epoxy tape or AF163-2 Scotchweld™ epoxy tape, commercially available from Minnesota Mining and Manufacturing Company, St. Paul, Minn., is applied to the support shoe 16. The frictional engagement material 38 is then preferably pressed onto the epoxy tape and cured to attach the frictional engagement material 38 to the support shoe 16. Additionally, a primer may be applied to the support shoe 16 before the epoxy tape is applied thereto, to improve adhesion between the epoxy tape and the support shoe. The primer may be, for example, EC2320 Primer, commercially available from Minnesota Mining and Manufacturing Company, St. Paul, Minn. Alternatively, the frictional engagement material may be integrally formed in the pressure face 18.

The preferred frictional engagement material 38 is a composite material of the type described in U.S. Pat. No. 5,049,165 (Tselesin), the contents of which are incorporated herein by reference. Generally, the composite material comprises a cellular carrier having a plurality of particles in precisely shaped cells. In one embodiment, particles are received within a cellular carrier and extend from the surface thereof.

Figure 5:
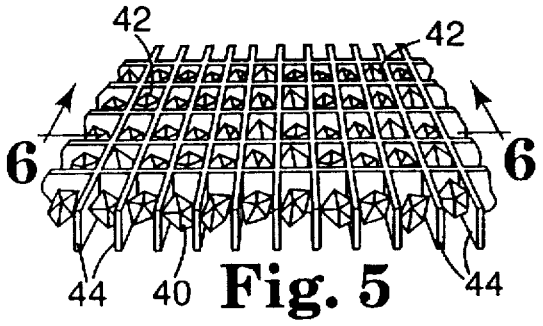
FIG. 5 is a perspective view of one form of the frictional engagement material made in accordance with the present invention, showing an integral, cellular carrier having particles within the cells thereof, the matrix material being omitted for clarity.

An exemplary frictional engagement material is shown in FIG. 5. As shown, there are particles 40 in most of the cells 42 of a cellular carrier 44. However, if less concentration of particles is desired, more cells will have no particles. For maximum concentration of particles, all cells will have particles.

It should be further understood that the cellular carriers shown are by way of illustration only, and are not intended to be exhaustive of the cellular carrier materials. The cellular structure may be a preformed metal fiber, a preformed metal powder, or a woven wire mesh. However, other materials that may be formed into the cellular configuration may also be appropriate, such as cemented carbides, ceramics, and organic and fiber graphite materials. As shown in FIG. 5, the cellular structure is in an egg crate configuration, but the actual skeletal structure may be formed of woven wire, or wires otherwise fastened together, as by welding or soldering. Further, the cellular structure may take the form of material that is expanded, punched, perforated, drilled, extruded, otherwise manipulated into a configuration that comprises a plurality of cells formed by some type of skeletal structure. Moreover, the cells do not necessarily extend completely through the frictional engagement material, but may instead comprise holes that are open only at their tops.

The particles 40 may include a variety of materials. It is preferred that the particles are diamonds, and more preferably are diamonds having a cubo-octahedral shape; i.e., having multiple sharp corners defining the points between flat surfaces. The diamonds may also have comers that have been rounded by tumbling or other processing so that the diamonds have no sharp comers. It is preferred that the diamonds are uncrushed "metal bond" diamonds. The particles may also be, for example, cubic boron nitride, boron carbide, tungsten carbide or other carbides, or crushed cemented carbide, as well as ceramic aluminum oxide or other ceramics. The particles 40 may also be a mixture of these listed substances or other particles.

The particles 40 may also be an agglomerate of particles, of the type taught in U.S. Pat. No. 4,652,275, entitled "Erodable Agglomerates and Abrasive Products Containing the Same" (Bloecher et al.); U.S. Pat. No. 4,799,939, entitled "Erodable Agglomerates and Abrasive Products Containing the Same" (Bloecher et al); U.S. Pat. No. 4,541,842, entitled "Glass Bonded Abrasive Agglomerates" (Rostoker); and U.S. patent application Ser. No. 08/085,638, entitled "Precisely Shaped Particles and method of Making the Same" (Holmes et al.), which is commonly owned by the assignee of the present invention. When the particles 40 are an agglomerate of particles, the frictional engagement material may be dressed to achieve a desired size and profile of the agglomerate extending from the cells. Dressing of abrasive agglomerates is described, for example, in PCT WO 92/05827 and PCT WO 95/09216.

In using a carrier material such as that shown in FIG. 5, the particles can be deposited onto the carrier, and the excess raked off so that only those particles that are within the cells 42 remain. More elaborate systems may be used if desired, especially if the concentration of particles 40 in the carrier is critical.

For the material to be usable as a frictional engagement material, the particles 40 should be held in the cells 42 of the carrier 44. Preferably, it matrix material 45 will serve to encapsulate the particles, at least partially, and to hold the particles in the cells 42 of the carrier 44. Many materials can be used as the matrix material, such as metal powders, metal fiber compositions, or powder and fiber mixtures, all either free or preformed. The matrix material 45 can substantially fill the cells 42, sufficiently to encapsulate the particles. The entire device can be sintered, with or without compression, or brazed or plasma sprayed, to bind the grains or fibers of the matrix material 45 together and hold the particles 40 in the cells 42. Alternatively, depending on the final characteristics desired, the matrix material 45 may be a resin, rubber or the like. A thermoplastic can be used, the thermoplastic being heated to encapsulate the particles, and subsequently cooled to hold the particles in place. A thermosetting resin can be used, the cells 42 being filled with the resin, the material then being heated, probably with some compaction or vacuum processing, to hold the particles 40 in place.

The matrix may contain some residual porosity and be acceptable, the porosity being in the range of 5–50%, including open porosity. The pores in the matrix can be filled with a material different from the matrix, for example, with a liquid or a solid lubricant. However, the best retention of hard particles is achieved at less than 5% porosity of the matrix.

It is not necessary that the skeletal structure remain a part of the frictional engagement material. Rather, the skeletal structure may be removed or burned off after the cells are formed. For one example, when the matrix material is an organic binder or some other material having sufficient integrity, the matrix material may be partially cured to form the cells, and the skeletal structure may then be removed. For another example, when the skeletal structure is an organic material, it may be burned off during sintering or other processing of the frictional engagement material, leaving the formed cells in place.

The structure shown in FIG. 5 is generally illustrative of a preferred embodiment of the composite material of the present invention, and many variations are possible. Some alternate preferred modes are illustrated in FIGS. 6 through 17.

Figure 6:
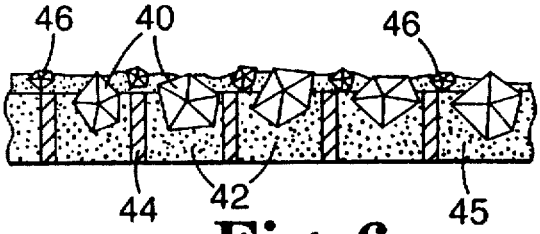
FIGS. 6 through 17 are cross-sectional views of frictional engagement materials taken along line 6—6 of FIG. 5 showing various modifications of the frictional engagement material illustrated in FIG. 5.

FIG. 6 shows a structure similar to the structure of FIG. 5, where the similar parts carry the same reference numerals. Thus, there is a single particle 40 in each cell 42 of the cellular carrier 44. In FIG. 6, the matrix material 45 is indicated by the stippling within the cells 42. It will be noted that at least some of the particles 40 protrude from the carrier 44 on at least one side of the carrier. The additional feature illustrated by FIG. 6 is the combination of additional particles 46 fixed to the skeleton of the carrier 44. The particles 46 may be held to the carrier 44 by electroplating or spraying; however, the matrix material 45 may also be used to secure these particles. In the latter case, the matrix material 45 will extend beyond the carrier 44 to encapsulate the particles 46 as well as the particles 40.

Figure 7:
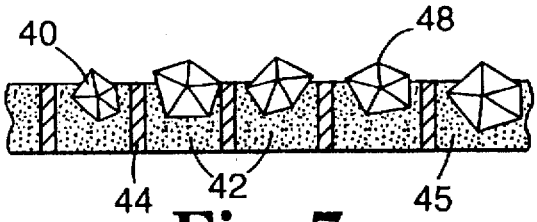
Figure 8:
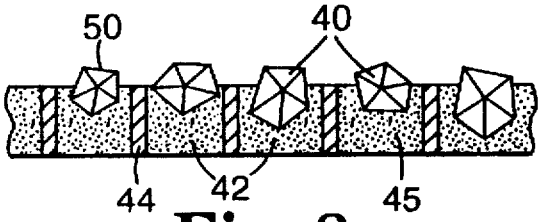

FIG. 7 is also similar to FIG. 5. The difference shown in FIG. 7 is the orientation of the majority of the particles 40 so that a point 48 faces generally outwardly of the carrier 44. FIG. 8 is similar to FIG. 7 but showing a particle orientation wherein the majority of the particles 40 have a facet 50 facing generally outwardly of the carrier 44.

Any time the particles are to be arranged in an orderly pattern, a piece of cellular carrier may be used to arrange the particles. The cellular as shown in FIG. 5 can be filled with particles, the material laid on another cellular carrier, and the first carrier removed to leave the particles in a regular pattern.

Figure 9:
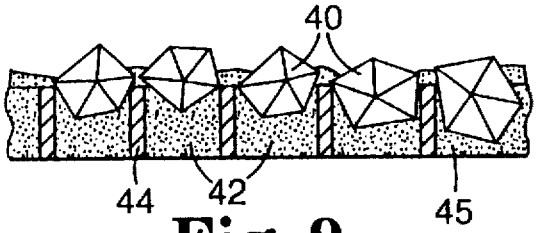

FIG. 9 illustrates a carrier 44 having cells 42 that are smaller than the particles 40. As a result, the particles 40 are not totally received within the cells 42. It is important to note, however, that the majority of the particles 40 extend sufficiently into a cell 42 to allow the skeleton of the carrier 44 to lend support to the particle. Therefore, it is not the matrix material 45 alone that supports the hard particles 40; rather, the majority of the hard particles 40 receive mechanical support from the cellular carrier material 44. As before, the matrix material 45 may extend beyond the carrier 44 to encapsulate the hard particles 40.

Figure 10:
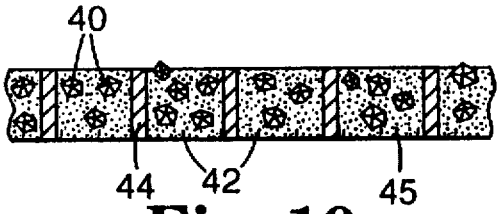

FIG. 10 illustrates a variation of the invention in which the particles 40 are smaller than the cells 42. In FIG. 10, a plurality of particles 40 is within each cell 42 of the carrier 44. In this embodiment of the invention, not every particle will have direct support from the skeleton of the carrier; however, the frictional engagement material will be divided into a plurality of cells, and each cell will have support from the cellular carrier material. Loss of one particle from the matrix material 45 in one cell can do no more than weaken the one cell of the frictional engagement material, and the other cells will remain intact. It will therefore be understood that the cellular material supports all the particles. However, some of the particles may be directly supported by the cellular material, and other particles may be supported indirectly through the matrix material.

The desired concentration of particles for each cell can be achieved by selecting the cell type and size, and considering the size and geometrical parameters of the particles. Maximum concentration of particles for each cell can be achieved by force packing the particles into the cells.

Figure 11:
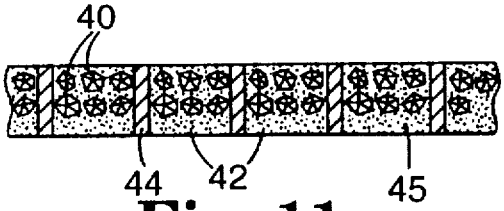
Figure 12:
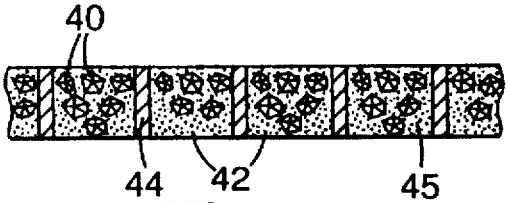

The embodiment of FIG. 11 is similar to the embodiment of FIG. 10, except that in FIG. 11 the plurality of particles 40 within each cell 42 are arranged in discrete layers. FIG. 12 shows a variation of FIG. 11 wherein the concentration of particles diminishes in each layer, and the opposite face of the carrier includes at least one layer with no hard particles. Obviously, many additional variations of the layers of particles may be made without departing from the scope of the present invention.

Figure 13:
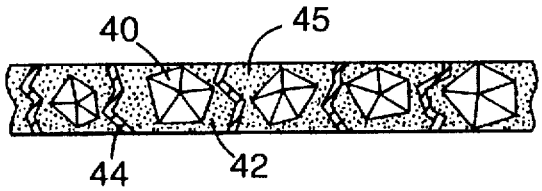

The embodiment shown in FIG. 13 is again similar to the embodiment shown in FIG. 5, but the cellular carrier 44 is here shown as partially crushed. It will be understood that, by using an egg crate-style carrier 44, particles can be placed into the cells 42, then the skeleton can be crushed to deform the skeleton and assist in retaining the particles within the cells 42. FIG. 13 illustrates a matrix material 45 filling the cells 42, but those skilled in the art will understand that the matrix material 45 may not be required for some composite materials, while it may be necessary for others. The important feature disclosed in FIG. 13 is the deformation of the skeleton of the cellular carrier to assist in mechanically holding the particles 40 within the cells 42. The deformation may be mechanical, as is illustrated in FIG. 11, or may be through heat.

The above descriptions have been concerned with a single piece of cellular carrier material, though the single carrier may have any thickness desired. It should now be understood that one might utilize a plurality of pieces of cellular carrier material bonded together to create a single, composite material.

Figure 14:
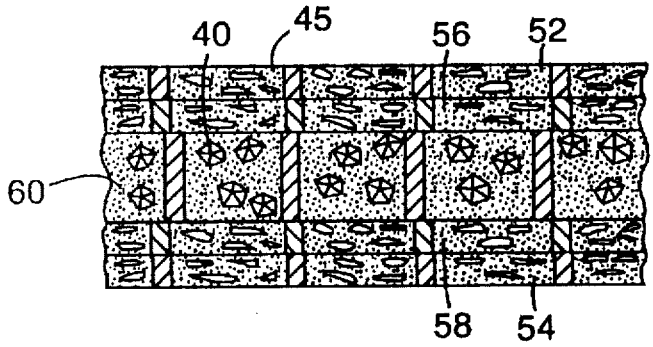

FIG. 14 shows a plurality of layers of frictional engagement material made in accordance with the present invention, the several layers being bonded together to create one frictional engagement material. As shown, each side of the material has two layers, each layer having a plurality of particles in each cell as illustrated in FIG. 10. The central portion of the material in FIG. 14 is also formed in accordance with the teaching of FIG. 10, but the central portion has a different cell from the outer layers. Thus, FIG. 14 shows outer layers 52 and 54 bonded to layers 56 and 58. Layers 52 through 58 are substantially alike but, of course, may differ in type and size of particle, as well as concentration of particles, and also type and size of cellular carrier. The central layer 60 has a larger cell, and may have a different concentration of particles 40, including a total absence of particles, and different type and size, as desired.

Figure 15:
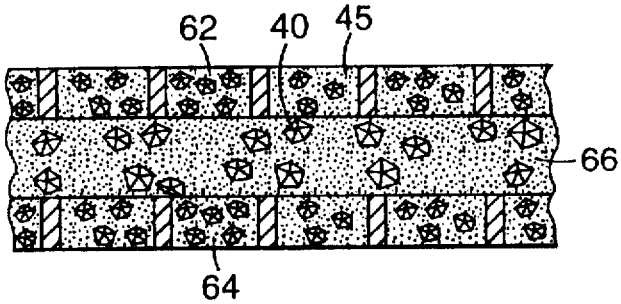

FIG. 15 is similar to FIG. 14, but the outer layers 62 and 64 are bonded to a central layer 66 that does not have a cellular carrier. Also, only one outer layer may be used if desired. In this event, the layer 66 will assist in holding the material together and allow continued performance if the cellular material becomes damaged.

In the embodiments of the invention shown in FIGS. 13 and 14, it is contemplated that the various layers of the frictional engagement material will be constructed as discussed for FIG. 10, then the various layers bonded together. Obviously, one may construct the several layers, then sinter the entire frictional engagement material at one time so bonding of the various layers is assured. In the embodiments of the invention shown in FIGS. 16 and 17, it is contemplated that the layers will first be prepared, then the particles pressed thereinto.

Figure 16:
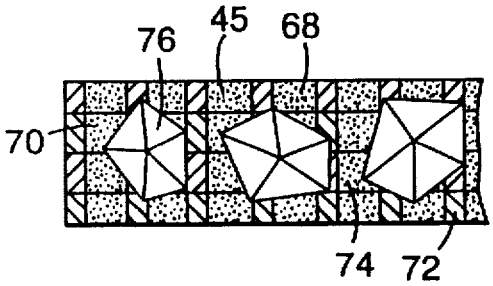

The embodiment of FIG. 16 includes four layers of cellular carrier material, and a plurality of particles embedded within the four layers. The particles are of a size exceeding the cell size of the carrier, and may exceed the cell size in one or more directions. The cells of the carrier are shown as filled with matrix material. Thus, the two layers 68 and 70 can be assembled, and the two layers 72 and 74 similarly assembled. A plurality of particles 76 in a single layer can then be placed between the layers, and the layers urged together, causing the particles 76 to deform the carriers sufficiently for the particles 76 to become embedded within the carriers. The composite can subsequently be sintered or otherwise cured to fix the matrix material.

Figure 17:
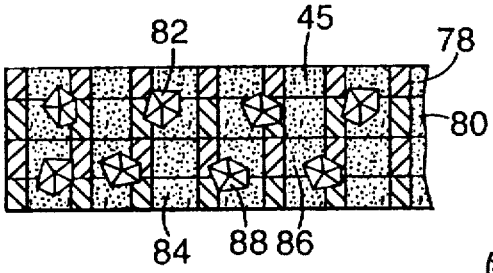

FIG. 17 is similar to FIG. 16, except that carrier layers 78 and 80 have particles 82 contained therein. Carrier layers 84 and 86 have particles 88 contained therein. The four carrier layers are then placed together, and the composite can be sintered or cured to fix the plurality of layers of particles, such as particles 82 and 88, within the matrix, and to fix the plurality of carrier layers together. As in FIG. 16, the hard particles may exceed the size of the cells, but in FIG. 17, there are two pairs of layers that are subsequently fixed together.

Figure 18:
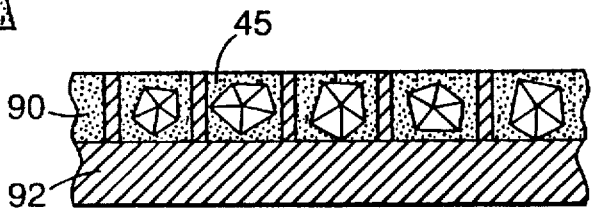
FIG. 18 is a cross-sectional view of a frictional engagement material of the present invention fixed to a substrate.

Once a frictional engagement material has been made in accordance with the above description, the frictional engagement material may be fixed to a substrate in order to lend additional characteristics to the material. For example, FIG. 18 illustrates generally a frictional engagement material 90 made in accordance with the present invention and fixed to a substrate 92.

The substrate 92 is not illustrated in detail, but those skilled in the art will understand that the substrate 92 may be a cellular or non-cellular material, and may be the same as the carrier, or the same as the matrix, for the material 90, or different therefrom. Also, the frictional engagement material 90 may be completed, and subsequently fixed to a substrate, or the frictional engagement material 90 and the substrate 92 may be assembled, and the entire assembly sintered or otherwise cured at one time.

After the frictional engagement material of the present invention has been completed, there are several surface treatments that may improve the material. One form of surface treatment includes the coating of the material with nickel, chromium, aluminum oxide, titanium nitride, boron carbide, diamond thin film, or a non-metal such as a polymeric substance. Such coatings may be applied through chemical vapor deposition, physical vapor deposition, ion implantation process, plasma spraying, or brazing. Other surface treatments include heat treatment, shot blasting or grinding to expose the hard particles, or dressing to obtain precision of size and profile. With these examples, numerous other treatments will suggest themselves to those skilled in the art.

In some of the described embodiments of the invention, the cellular carrier includes a skeleton that provides mechanical support for the particles of the material. The skeleton may take the form of the egg crate shown in several of the drawings, or may be wires, or may be grains of powder or fibers that constitute the carrier itself. For example, a preformed matrix of metal fiber, metal powder, or a powder-fiber combination, can have the hard particles urged thereinto, then the matrix can be sintered, with or without pressure, or brazed or plasma sprayed. The metal grains or fibers of the matrix, in this instance, can serve the function of the skeleton of the carrier. Whatever form the skeleton of the carrier takes, the skeleton provides mechanical support for the hard particles, either directly, or indirectly through the matrix, to assist in holding the particles against forces that will tend to remove the particles from the composite material.

The selection and arrangement of the particles is also subject to considerable variation. The frictional engagement material may be made with a single size of particles, or with a mixture of different sizes, in one piece of material, and with a single type, or a mixture of several types in one piece of material. A single layer may have a single size and type of particle, with successive layers of different sizes and types, or each layer may be of mixed sizes and types. Of course, a material such as that shown in FIG. 10 may be made with a generally homogeneous mixture of particles of different sizes and types so there is no specific arrangement of the specific types and sizes of particles. Those skilled in the art will understand that the particular characteristics of a frictional engagement surface can be determined through proper selection of specific hard particles, and sizes of particles for specific sections or layers of the frictional engagement material.

Those skilled in the art will also realize that some portion of the particles should be embedded in the matrix material 45 to provide enough holding force for the frictional engagement material to be useful. For engagement with the back face of the abrasive to be sufficient to attenuate slippage, it is preferred that the particles protrude from the matrix material. The maximum preferred protrusion is about three-fourths of the particle size; i.e., one-fourth of the volume of the particle is embedded in the matrix material, and three-fourths protrudes therefrom. However, it is within the scope of the invention that between one one-hundredth and one-third of the particle protrudes from the matrix material. It is also preferred that between one-fourth and three-fourths of each particle is encapsulated within the matrix material. More or less protrusion may be used depending on the characteristics of the frictional engagement material, the abrasive tape, and on the desired degree of slip attenuation.

It will therefore be seen that the present invention provides a frictional engagement material that may contain any desired concentration of diamonds or other particles for frictional engagement with an abrasive tape. An optional cellular carrier material has a skeleton that supports the hard particles for providing a durable material. A matrix material 45 secures the particles within the carrier, and may extend beyond the carrier. The matrix material 45 can be any of a wide variety of materials.

Referring again to the embodiment illustrated in FIG. 4, when the frictional engagement material 38 is brought into contact with the backing layer 36 of the substrate 26, frictional forces between the extending particles 40 and the backing layer 36 tend to cause those materials to remain in contact with each other in response to shear forces, including shear forces induced by rotary abrading. The frictional engagement material 38 and the backing layer 36 or substrate 26 are preferably selected so that when the two materials are brought in contact with each other, the abrasive tape 22 is positioned and retained in a particular position with respect to support shoe 16 during abrading. During abrading, when a rotating workpiece may apply a high shear force, the abrasive tape thereby remains firmly secured to the support shoe, and preferably does not slip with respect to the support shoe or slips a slight, acceptable amount. However, when it is necessary to index the abrasive tape, the abrasive tape will need to be separated from the frictional engagement material by displacing the abrasive tape from the pressure face of the support shoe. Therefore, the backing layer 36 and the frictional engagement material 38 are preferably selected such that the materials are easily separated when subjected to a relatively low peel force.

Specifically, to attenuate slippage between the abrasive tape 22 and the pressure face 18, the coefficient of friction between the backing layer 36 or the substrate 26 and the frictional engagement material 38 should be greater than the coefficient of friction between the abrasive coating on the abrasive tape 22 and the object that is being abraded. If the coefficient of friction between the backing layer 36 or the substrate 26 and the frictional engagement material 38 is lower than the coefficient of friction between the abrasive coating on the abrasive tape 22 and the object that is being abraded, the abrasive tape 22 will tend to slip with respect to the pressure face 18. More specifically, it is preferred that the coefficient of friction between the backing layer 36 or the substrate 26 and the frictional engagement material 38 is at least 5 percent, and is more preferably at least 15 percent greater than the coefficient of friction between the abrasive coating on the abrasive tape 22 and the object that is being abraded.

When the substrate 26 has a backing layer 36 thereon, the frictional engagement material 38 and backing layer 36 are also preferably selected so that the particles 40 grip or cut at least partially into the backing layer 36 without cutting into the substrate 26. In this way, the particles 40 hold the backing layer 36 of the abrasive tape 22 to the pressure face 18. It is preferable that the particles penetrate into at least 25 percent of the thickness of the backing layer 36, but also preferably less than 100 percent of the thickness of the backing layer 36. The frictional engagement between the frictional engagement material 38 and the abrasive tape 22 is often weaker as the level of particle penetration decreases.

If the particles 40 penetrate the entire thickness of the backing layer 36, they may also contact or penetrate the substrate 26. This may cause the substrate to rip or tear. Although it is contemplated that some of the particles 40 may contact or penetrate the substrate 26, thereby causing small tears or rips in the substrate, if a significant number of the particles penetrate the substrate 26, the substrate 26 may become so damaged that it becomes unusable. To prevent this damage to the substrate 26, it is therefore desirable to select the abrasive tape 22 and the frictional engagement material 38 so that the particles 40 only cut into the backing layer 36 and do not extend into the substrate 26.

When the abrasive tape has no backsize coating or when the substrate 26 is a resilient foam, the substrate 26 and frictional engagement material 38 are preferably selected so that the substrate 26 is at least 1.5 times as thick as the distance the particles 40 penetrate the substrate 26. It is more preferable that the substrate 26 is at least 2 times as thick as the distance the particles 40 penetrate the substrate 26, and even more preferable that the substrate 26 is at least 3 times as thick. However, the particles 40 may penetrate the entire thickness of the substrate 26.

Figure 19:
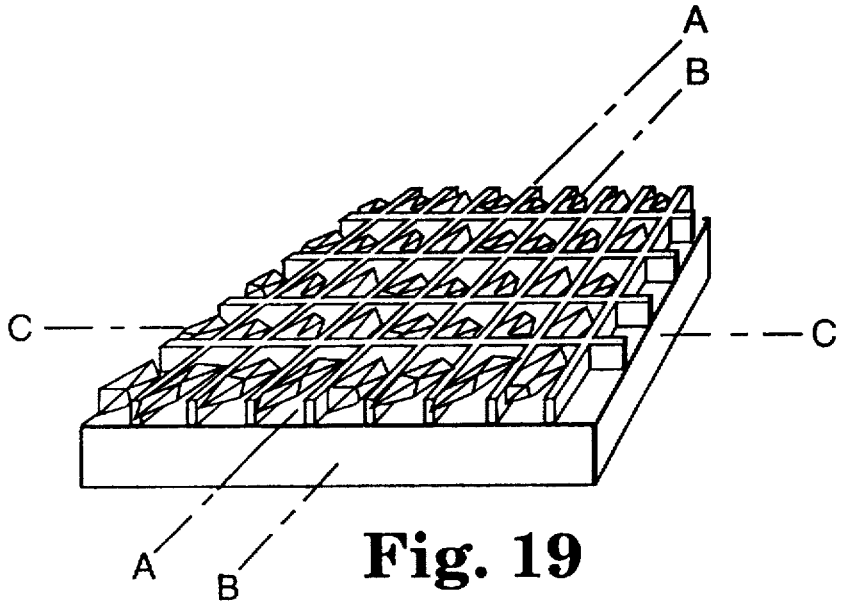
FIG. 19 is a perspective view of a portion of a support shoe having a frictional engagement material attached thereto.

To further attenuate slippage between the abrasive tape 22 and the pressure face 18, the orientation of the abrasive tape 22 with respect to the pressure face 18 may be varied. As illustrated in FIG. 19, the frictional engagement material 38 has an axis A that is generally parallel to rows of cells 42, and the pressure face 18 has an axis B that is generally parallel to the direction that the workpiece is rotated during the abrading process. Typically, the pressure face 18 has a major axis B and a minor axis C, where the major axis B extends generally in the direction of the longest side of the pressure face 18, and where the minor axis C is perpendicular to the major axis B. In the embodiment of FIG. 19, the axis A of the frictional engagement material 38 is parallel to the axis B of the pressure face 18. This alignment of rows of cells 42 and particles 40 in the direction of indexing can cause a grooved pattern in the backing layer 36 or substrate 26 of some abrasive tapes if the abrasive tape slips during the abrading operation, which can thereby decrease the coefficient of friction between the backing layer 36 or the substrate 26 and the frictional engagement material 38.

Figure 20:
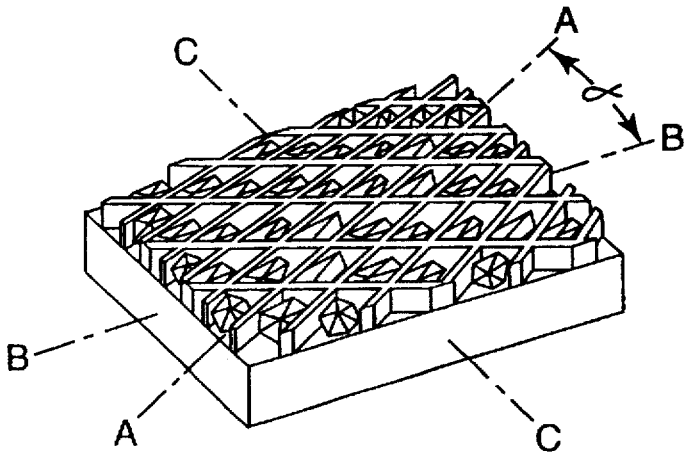
FIG. 20 is a perspective view of a portion of a support shoe having a frictional engagement material attached thereto, the frictional engagement material being rotated with respect to the support shoe.

Alternatively, the frictional engagement material 38 may be rotated with respect to the pressure face 18 so that the axis A is offset at an angle $\alpha$ with respect to axis B, as illustrated in FIG. 20. In other words, the axis A is oblique to the axis B. In this embodiment, the particles 40 are not aligned in rows with respect to the direction that the workpiece is rotated, which can minimize grooved patterns in the backing layer 36 or substrate 26 and thereby increase the coefficient of friction between the backing layer 36 or the substrate 26 and the frictional engagement material 38. Further, if the angle $\alpha$ is 45 degrees, the particles 40 will be arranged in rows in the same manner as when the axis A is parallel to the axis B. Therefore, the angle $\alpha$ is preferably in the range of approximately 1 degree to 44 degrees or in the range of approximately 46 degrees to 89 degrees, where it is understood that the arrangement of particles 40 with respect to the direction of indexing is generally more random the further the angle $\alpha$ is from 0 degrees, 45 degrees, and 90 degrees.

The operation of the present invention will be further described with regard to the following detailed examples. These examples are offered to further illustrate the various specific and preferred embodiments and techniques. It should be understood, however, that many variations and modifications may be made while remaining within the scope of the present invention. The methods of making the frictional engagement material and test samples and the test procedure used were as follows:

A slip test was performed by placing an abrasive tape with its back side against the pressure face of a support shoe of the type generally used for crankshaft finishing. The width of the support shoe was approximately 1.59 cm (0.625 in), and the abrasive tape measured approximately 1.9 cm (0.75 in) wide. A metal roller having a diameter approximately equal to the diameter of a cam lobe that could be abraded by this support shoe was placed in contact with the exposed abrasive surface of the abrasive tape. A normal force of approximately 1.5 kg (4 lbs) was applied to the support shoe in the direction of the metal roller. The support shoe was held in place, and the metal roller was allowed to move along with the abrasive tape.

A standard spring scale having a hook attachment device was attached to one end of the abrasive tape by inserting the hook of the spring scale through a hole punched in one end of the abrasive tape. A tensile force was applied to the abrasive tape in a direction generally parallel to the surface of the support shoe that was in contact with the roller. During testing, the force on the abrasive tape gradually increased until the tape slipped with reference to the support shoe. The force value, which is recorded in the following table, occurred after the tape began to slip. The coefficient of friction was then determined based on these force values.

THE EXAMPLES

The Comparative Example represents a test conducted with a support shoe that did not comprise a frictional engagement material having a plurality of cells with particles extending from the surface thereof according to the present invention. Instead, the support shoe surface included a random scattering of diamonds held in place with electroplated nickel, where the spacing of the diamonds and extension of the diamonds from the surface of the support shoe was essentially random. Specifically, the support shoe used is commercially available from Industrial Metal Products Corp. (IMPCO) of Lansing, Mich., part number 59VP001. The diamonds were generally flat in shape, and extended from the support shoe surface by approximately 3 mils (75 microns).

Examples One, Two, and Three represent tests conducted with frictional engagement materials having three different particle configurations according to the present invention. All of the frictional engagement materials were made by screening diamond particles so they passed through a standard 120 mesh sieve and were retained on a standard 140 mesh sieve. These diamonds were then sorted by shape, where the particles having a generally symmetrical cubo-octahedral shape with many sharp corners were sorted from those particles having a more cubic shape. In Example One, the diamond particles used in the frictional engagement material were mainly cubo-octahedral in shape and extended from the frictional engagement surface by approximately 1.8 mils (47 microns). In Example Two, the diamond particles used in the frictional engagement material were more cubic in shape and extended from the frictional engagement material by approximately 1.8 mils (47 microns). In Example Three, the diamond particles extended from the frictional engagement material by approximately 0.7 mils (19 microns).

A standard T-120 screen made of 303 stainless steel having a square weave of one hundred twenty 0.010 inch wires per inch was used as the mesh to define the cells of the frictional engagement material. A metal matrix powder was then used to hold the diamond particles which were positioned within the mesh material. The mesh, metal matrix material, and diamond particles were temporarily held together with an organic binder. This configuration was heated to 500° C. for several minutes to burn off the binder. The configuration was then sintered at 775° C. for 5 minutes to bond the diamonds within the frictional engagement material.

The frictional engagement material was then shaped to match the contour of the support shoe and was attached to the support shoe surface with an AF126 Scotchweld™ epoxy tape, commercially available from Minnesota Mining and Manufacturing Company, St. Paul, Minn. A punch having the opposite shape of the support shoe was pressed against the surface of the frictional engagement surface to hold the material in place and this configuration was heated for 1 hour at 120° C.

The abrasive tape used for each of the examples was a 5 mil 3M 272L Type S IMPERIAL Brand aluminum oxide microfinishing film having a 60 micrometer abrasive surface, which is commercially available from Minnesota Mining and Manufacturing Company of St. Paul, Minn. The abrasive tape included a slip resistant coating comprising calcium carbonate on the back face of the tape.

RESULTS

The results of the Comparative Example and Examples One, Two, and Three are tabulated below.

| | Force Required for Slippage of the Abrasive Tape | Coefficient of Friction |
|---|---|---|
| Comparative Example | 2.13 pounds | 0.54 |
| Example One | 2.92 pounds | 0.74 |
| Example Two | 2.49 pounds | 0.63 |
| Example Three | 2.13 pounds | 0.54 |

Higher force values indicate that the abrasive tape was more resistant to slippage with respect to the support shoe. The tabulated data therefore illustrates that the present invention, best illustrated in Examples One and Two, tends to resist relative displacement between the abrasive tape and the support shoe to a greater degree than support shoe surfaces comprising randomly scattered diamonds. Because the diamonds of Example Three were embedded further into the frictional engagement material than is desirable for the present invention, the material of this example did not resist abrasive tape displacement as well as Examples One and Two. The tests and test results described above are intended solely to be illustrative, rather than predictive, and variations in the testing procedure can be expected to yield different results.

It is also within the scope of the present invention to index the abrasive tape periodically to provide a new abrasive surface for application to the workpiece. In use, support shoes 14 and 16 urge abrasive tape 22 against the workpiece for a given period of time, and then the support shoes separate from the workpiece. The frictional engagement material 38 and the backing layer 36 are released from one another by indexing means 80 and 82 shown schematically in FIG. 2, and then at least one of either the abrasive tape or the support shoes is indexed relative to the other. That is, a predetermined length of abrasive tape is withdrawn from the area where the abrasive contacts the workpiece, which thereby draws an equal length of new abrasive tape into the area for contact with the workpiece. An advantage of the present invention is that frictional engagement provides high shear resistance while readily allowing the tape and engaging material to be disengaged normal to one another, enabling facile indexing of the abrasive tape. When the abrasive tape has been advanced sufficiently, the support shoes dose around the workpiece, and cause the engaging material 38 to contact and frictionally engage the backing layer 36 to retain the abrasive tape with respect to the pressure face. The abrading process may then begin again.

The present invention has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. For instance, although the present invention has particular utility with respect to microfinishing journals (such as camshafts and crankshafts), cam lobes, and superfinishing and ID tube honing applications, other applications and workpieces are also contemplated. Thus, the scope of the present invention should not be limited to the structures described herein, but only by the structures described by the language of the claims and the equivalents of those structures.

We claim:

1. A support shoe for supporting an abrasive tape having an abrasive face and an opposed back face, the support shoe comprising:

a pressure face including a frictional engagement material for frictionally engaging the back face of the abrasive tape, wherein the frictional engagement material comprises:

a plurality of cells; and a first frictional engagement surface comprising a plurality of particles distributed and arranged within the plurality of cells, wherein at least some of the plurality of particles are fixed within and extend from the plurality of cells, so that when the back face of the abrasive tape contacts the first frictional engagement surface, the plurality of particles attenuate relative movement between the abrasive tape and the pressure face in response to shear forces induced during abrading, wherein the pressure face has a length and a major axis that is parallel to the length of the pressure face, wherein the plurality of cells are arranged in a plurality of rows having a cell axis that is parallel to the plurality of rows, and wherein the major axis of the pressure face is parallel to the cell axis.

2. The support shoe of claim 1, wherein the frictional engagement material is adhered to the pressure face with an epoxy.

3. The support shoe of claim 1, wherein the frictional engagement material is adhered to the pressure face with a primer and an epoxy.

4. The support shoe of claim 1, wherein the frictional engagement material is soldered to the pressure face.

5. The support shoe of claim 1, wherein each cell of the plurality of cells contains one particle of the plurality of particles.

6. The support shoe of claim 1, wherein each cell of the plurality of cells receives multiple particles of the plurality of particles.

7. The support shoe of claim 1, wherein the plurality of particles comprise agglomerate particles.

8. A support shoe for supporting an abrasive tape having an abrasive face and an opposed back face, the support shoe comprising:

a pressure face including a frictional engagement material for frictionally engaging the back face of the abrasive tape, wherein the frictional engagement material comprises:

a plurality of cells; and a first frictional engagement surface comprising a plurality of particles distributed and arranged within the plurality of cells, wherein at least some of the plurality of particles are fixed within and extend from the plurality of cells, so that when the back face of the abrasive tape contacts the first frictional engagement surface, the plurality of particles attenuate relative movement between the abrasive tape and the pressure face in response to shear forces induced during abrading, wherein the pressure face has a length and a major axis that is parallel to the length of the pressure face, wherein the plurality of cells are arranged in a plurality of rows having a cell axis that is parallel to the plurality of rows, and wherein the major axis of the pressure face is oblique to the cell axis.

9. The support shoe of claim 8, wherein the frictional engagement material is adhered to the pressure face with an epoxy.

10. The support shoe of claim 8, wherein the frictional engagement material is adhered to the pressure face with a primer and an epoxy.

11. The support shoe of claim 8, wherein the frictional engagement material is soldered to the pressure face.

12. The support shoe of claim 8, wherein each cell of the plurality of cells contains one particle of the plurality of particles.

13. The support shoe of claim 8, wherein each cell of the plurality of cells receives multiple particles of the plurality of particles.

14. The support shoe of claim 8, wherein the plurality of particles comprise agglomerate particles.

15. An apparatus for abrading an outer peripheral surface of a workpiece, comprising:

an abrasive tape having an abrasive face and an opposed back face;

support means having a pressure face for supporting the abrasive tape thereon and for urging the abrasive tape against the workpiece, the pressure face including a frictional engagement material for frictionally engaging the back face of abrasive tape, wherein the frictional engagement material comprises;

a plurality of cells; and a first frictional engagement surface comprising a plurality of particles distributed and arranged within the plurality of cells, wherein at least some of the plurality of particles are fixed within and extend from the plurality of cells, so that when the back face of the abrasive tape contacts the first frictional engagement surface, the plurality of particles attenuate relative movement between the abrasive tape and the pressure face in response to shear forces induced during abrading; and means for rotating one of the workpiece and the support means relative to the other of the workpiece and the support means, whereby the abrasive face abrades material from the outer peripheral surface of the workpiece during relative rotation between the workpiece and the support means, wherein a first coefficient of friction is induced between the back face of the abrasive tape and the first frictional engagement surface and a second coefficient of friction is induced between the abrasive face and the outer peripheral surface of the workpiece during relative rotation between the workpiece and the support means, and wherein the first coefficient of friction is larger than the second coefficient of friction.

16. The apparatus of claim 15, wherein the first coefficient of friction is at least 5 percent higher than the second coefficient of friction.

17. The apparatus of claim 16, wherein the first coefficient of friction is at least 15 percent higher than the second coefficient of friction.

18. An apparatus for abrading an outer peripheral surface of a workpiece, comprising:

an abrasive tape having an abrasive face and an opposed back face;

support means having a pressure face for supporting the abrasive tape thereon and for urging the abrasive tape against the workpiece, the pressure face including a frictional engagement material for frictionally engaging the back face of abrasive tape, wherein the frictional engagement material comprises;

a plurality of cells; and a first frictional engagement surface comprising a plurality of particles distributed and arranged within the plurality of cells, wherein at least some of the plurality of particles are fixed within and extend from the plurality of cells, so that when the back face of the abrasive tape contacts the first fictional engagement surface, the plurality of particles attenuate relative movement between the abrasive tape and the pressure face in response to shear forces induced during abrading; and means for rotating one of the workpiece and the support means relative to the other of the workpiece and the support means, whereby the abrasive face abrades material from the outer peripheral surface of the workpiece during relative rotation between the workpiece and the support means, wherein the pressure face has a major axis parallel to a direction of relative rotation induced by the rotating means between the workpiece and the support means, wherein the plurality of cells are arranged in a plurality of rows having a cell axis that is parallel to the plurality of rows, and wherein the major axis of the pressure face is parallel to the cell axis.

19. An apparatus for abrading an outer peripheral surface of a workpiece, comprising:

an abrasive tape having an abrasive face and an opposed back face;

support means having a pressure face for supporting the abrasive tape thereon and for urging the abrasive tape against the workpiece, the pressure face including a frictional engagement material for frictionally engaging the back face of abrasive tape, wherein the frictional engagement material comprises;

a plurality of cells; and a first frictional engagement surface comprising a plurality of particles distributed and arranged within the plurality of cells, wherein at least some of the plurality of particles are fixed within and extend from the plurality of cells, so that when the back face of the abrasive tape contacts the first frictional engagement surface, the plurality of particles attenuate relative movement between the abrasive tape and the pressure face in response to shear forces induced during abrading; and means for rotating one of the workpiece and the support means relative to the other of the workpiece and the support means, whereby the abrasive face abrades material from the outer peripheral surface of the workpiece during relative rotation between the workpiece and the support means, wherein the pressure face has a major axis parallel to a direction of relative rotation induced by the rotating means between the workpiece and the support means, wherein the plurality of cells are arranged in a plurality of rows having a cell axis that is parallel to the plurality of rows, and wherein the major axis of the pressure face is oblique to the cell axis.

* * * * *